US009500169B2

(12) United States Patent
Lehmann et al.

(10) Patent No.: US 9,500,169 B2
(45) **Date of Patent: *Nov. 22, 2016**

(54) LEVER DEVICE AND A FUEL INJECTION VALVE

(71) Applicants: Stefan Lehmann, Lappersdorf (DE); Hellmut Freudenberg, Pentling / Grossberg (DE);
(Continued)

(72) Inventors: Stefan Lehmann, Lappersdorf (DE); Hellmut Freudenberg, Pentling / Grossberg (DE);
(Continued)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 173 days.

This patent is subject to a terminal disclaimer.

(21) Appl. No.: 14/369,812

(22) PCT Filed: Dec. 19, 2012

(86) PCT No.: PCT/EP2012/076183
§ 371 (c)(1),
(2) Date: Jun. 30, 2014

(87) PCT Pub. No.: WO2013/098161
PCT Pub. Date: Jul. 4, 2013

(65) Prior Publication Data

US 2015/0028135 A1 Jan. 29, 2015

(30) Foreign Application Priority Data

Dec. 30, 2011 (DE) ..... 10 2011 090 196

(51) Int. Cl.
*F02M 61/00* (2006.01)
*F02M 51/06* (2006.01)
(Continued)

(52) U.S. Cl.
CPC ..... *F02M 51/0603* (2013.01); *F02M 61/10* (2013.01); *F02M 61/168* (2013.01); *F02M 63/0026* (2013.01); *F02M 2200/702* (2013.01)

(58) Field of Classification Search
CPC ..... F02M 61/10; F02M 51/0603; F02M 63/702; F02M 61/168; F02M 2200/703
(Continued)

(56) References Cited

U.S. PATENT DOCUMENTS 3,945,261 A 3/1976 Wright ..... 74/110
4,863,141 A 9/1989 Brunner ..... 251/129.2
(Continued)

FOREIGN PATENT DOCUMENTS

DE 19757659 C1 6/1999
DE 19857615 C1 7/2000
(Continued)

OTHER PUBLICATIONS

International Search Report and Written Opinion, Application No. PCT/EP2012/076158, 14 pages, Mar. 22, 2013.
(Continued)

*Primary Examiner* — Arthur O Hall
*Assistant Examiner* — Viet Le
(74) *Attorney, Agent, or Firm* — Slayden Grubert Beard PLLC

(57) ABSTRACT

A lever device for a fuel injection valve includes a housing with a housing recess, at least one lever element arranged in the housing recess, a drive element arranged in the housing recess and coupled to the lever element(s) in order to act upon said at least one lever element in a direction of a force-action axis, and an output element arranged in the housing recess and coupled to the lever element(s) such that this output element is moveable in the force-action axis
(Continued)

direction by the at least one lever element. Each lever element includes a coupling section designed or arranged such that the lever element is coupled to the housing, or to the output element, in a rotationally-fixed manner with respect to the force-action axis.

12 Claims, 2 Drawing Sheets

(71) Applicants: Stefan Kohn, Hohenburg (DE); Robert Kuchler, Regen (DE); Manuel Hannich, Regensburg (DE); Roland Feigl, Regensburg (DE); Wolfgang Wechler, Regensburg (DE); Matthias Wicke, Wernberg-Koeblitz (DE)

(72) Inventors: Stefan Kohn, Hohenburg (DE); Robert Kuchler, Regen (DE); Manuel Hannich, Regensburg (DE); Roland Feigl, Regensburg (DE); Wolfgang Wechler, Regensburg (DE); Matthias Wicke, Wernberg-Koeblitz (DE)

(51) Int. Cl.
*F02M 63/00* (2006.01)
*F02M 61/16* (2006.01)
*F02M 61/10* (2006.01)

(58) Field of Classification Search
USPC ..... 239/533.1–533.12, 584, 585.1–585.5; 251/231, 129.06, 129.19, 129.2
See application file for complete search history.

(56) References Cited

U.S. PATENT DOCUMENTS

| | | | | |
|---|---|---|---|---|
| 5,121,730 | A | 6/1992 | Ausman et al. | 123/467 |
| 6,186,474 | B1 | 2/2001 | Fitzner et al. | 251/229 |
| 6,595,436 | B2 | 7/2003 | Kirzhner et al. | 239/102.2 |
| 6,607,178 | B1 | 8/2003 | Lixl et al. | 251/229 |
| 6,705,587 | B1 | 3/2004 | Frank et al. | 251/129.06 |
| 6,776,390 | B1 | 8/2004 | Boecking | 251/129.06 |
| 6,787,973 | B2 | 9/2004 | Frank et al. | 310/328 |
| 7,225,790 | B2 | 6/2007 | Bartunek et al. | 123/294 |
| 7,404,539 | B2 | 7/2008 | Kronberger | 251/129.06 |
| 2003/0160202 | A1 | 8/2003 | Boecking | 251/229 |
| 2009/0200406 | A1* | 8/2009 | Kronberger | F02M 51/0603 239/585.5 |
| 2012/0031378 | A1 | 2/2012 | Brandt | 123/490 |
| 2013/0037622 | A1 | 2/2013 | Kim et al. | 239/5 |
| 2013/0153675 | A1 | 6/2013 | Kronberger et al. | 239/1 |
| 2014/0346244 | A1 | 11/2014 | Russe et al. | 239/4 |
| 2015/0021418 | A1 | 1/2015 | Lehmann et al. | 239/584 |
| 2015/0028135 | A1 | 1/2015 | Lehmann et al. | 239/584 |

FOREIGN PATENT DOCUMENTS

| | | | | |
|---|---|---|---|---|
| DE | 10002720 | A1 | 3/2001 | |
| DE | 10220498 | A1 | 11/2002 | |
| DE | 10304240 | A1 | 10/2004 | |
| DE | 10326707 | B3 | 1/2005 | |
| DE | 102005020366 | A1 | 11/2006 | |
| DE | 102005024707 | A1 | 12/2006 | |
| DE | 102006017034 | A1 | 10/2007 | |
| DE | 102006031567 | A1 | 1/2008 | F02M 51/06 |
| WO | 99/17014 | A1 | 4/1999 | |
| WO | 02/057622 | A1 | 7/2002 | |
| WO | 2004/076848 | A1 | 9/2004 | |
| WO | 2007/116007 | A1 | 10/2007 | |
| WO | 2013/098155 | A1 | 7/2013 | F02M 51/06 |
| WO | 2013/098161 | A1 | 7/2013 | F02M 51/06 |

OTHER PUBLICATIONS

International Search Report and Written Opinion, Application No. PCT/EP2012/076183, 15 pages, Mar. 22, 2013.

U.S. Notice of Allowance, U.S. Appl. No. 14/369,837, 13 pages, Mar. 1, 2016.

* cited by examiner

LEVER DEVICE AND A FUEL INJECTION VALVE

CROSS-REFERENCE TO RELATED APPLICATIONS

This application is a U.S. National Stage Application of International Application No. PCT/EP2012/076183 filed Dec. 19, 2012, which designates the United States of America, and claims priority to DE Application No. 10 2011 090 196.5 filed Dec. 30, 2011, the contents of which are hereby incorporated by reference in their entirety.

TECHNICAL FIELD

The invention relates to a lever device for an injection valve having a housing, at least one lever element, a drive element and an output element. Furthermore, the invention relates to an injection valve for an internal combustion engine of a motor vehicle, which injection valve has the lever device and a valve needle which is coupled to the output element or which forms the output element.

BACKGROUND

Injection valves for an internal combustion engine of a motor vehicle can have actuators which are configured, in particular, as piezo-electric actuators. Actuators of this type have a piezo-ceramic material. Actuators of this type can change their longitudinal extent depending on an electric field which acts in the piezo-ceramic material. Furthermore, a lever device can be provided which transmits the stroke of the actuator.

Piezo-electric actuators which are used as actuating members, in particular in injection valves for internal combustion engines in motor vehicles, are arranged in a housing in such a way that a stroke movement can be performed in the axial direction.

SUMMARY

One embodiment provides a lever device for an injection valve, the lever device comprising a housing having a housing recess, at least one lever element arranged in the housing recess, a drive element arranged in the housing recess and coupled to the at least one lever element for acting on the at least one lever element in a direction of a force action axis, and an output element arranged in the housing recess and coupled to the at least one lever element such that the output element is moveable in the direction of the force action axis by the at least one lever element, wherein each of the at least one lever element comprises a coupling section configured or arranged such that the at least one lever element is fixedly coupled to the housing or to the output element such that at least one lever element rotates with the housing or the output element around the force action axis.

In a further embodiment, the coupling section of each lever element comprises a planar wall section that interacts with a corresponding planar wall section of the output element such that each lever element is fixedly coupled to the output element such that each lever element rotates with the output element around the force action axis.

In a further embodiment, the coupling section of each lever element comprises a planar wall section that interacts with a corresponding planar wall section of the housing recess such that each lever element is fixedly coupled to the housing such that each lever element rotates with the housing around the force action axis.

In a further embodiment, the coupling section of each lever element comprises a recess, and the housing comprises a pin arranged in the recess of the coupling section of each lever element such that the each lever element is fixedly coupled to the housing fixedly such that each lever element rotates with the housing around the force action axis.

Another embodiment provides an injection valve, comprising a lever device a disclosed above, and a valve needle coupled to or defining the output element, wherein the drive element of the lever device and the valve needle are coupled to each another such that, based on an actuating signal, the valve needle prevents a fluid flow through the injection valve in a closed position of the valve needle and releases a fluid flow through the injection valve in other positions of the valve needle.

BRIEF DESCRIPTION OF THE DRAWINGS

Example embodiments of the invention are explained below with reference to the drawings, in which.

DETAILED DESCRIPTION

Figure 1:
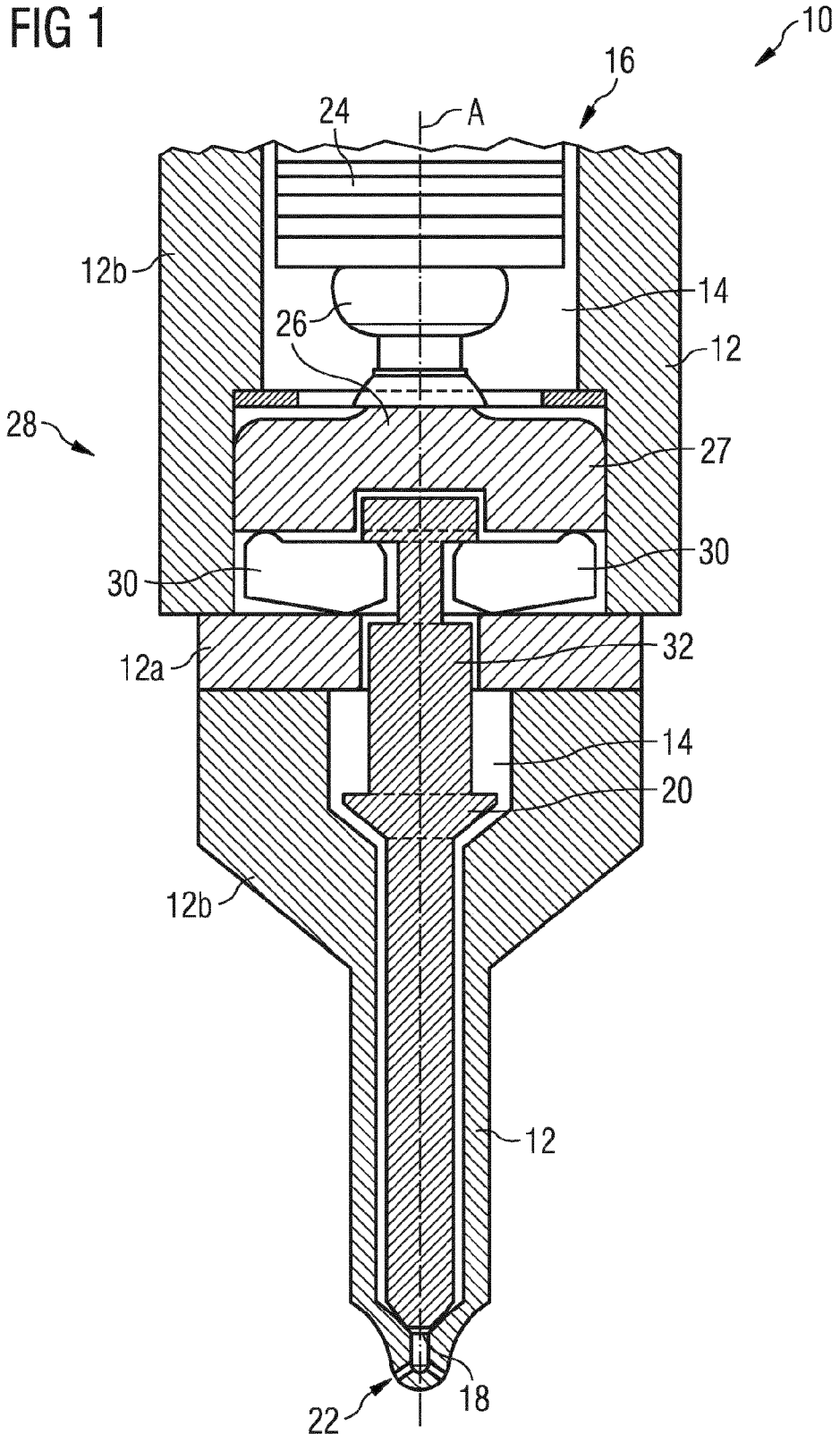
FIG. 1 shows a diagrammatic illustration of an injection valve.

Embodiments of the invention to provide a lever device for an injection valve which has long-term reliability. Other embodiments provide an injection valve which has a long service life.

Some embodiments provide a lever device for an injection valve, having a housing which has a housing recess, at least one lever element which is arranged in the housing recess, a drive element which is arranged in the housing recess and is coupled to the at least one lever element for acting on the at least one lever element in the direction of a force action axis, and an output element which is arranged in the housing recess. The output element is coupled to the at least one lever element in such a way that the output element can be moved in the direction of the force action axis by means of the at least one lever element. The at least one lever element has a coupling section which is configured or arranged in such a way that the at least one lever element is coupled to the housing or the output element fixedly so as to rotate with it with regard to the force action axis.

The at least one lever element is fixed rotationally with respect to the housing or the output element with regard to the force action axis.

This has the advantage that the at least one lever element is prevented from performing a rotational movement with respect to the housing or the output element, as a result of which changes in the injection quantities can be avoided which can be produced as a result of a rotational movement of this type of the at least one lever element. The at least one lever element is thus positioned reliably with respect to the housing or the output element. As a result, long-term reliable operation of the lever device can be made possible.

In one embodiment, the coupling section of the lever element has a planar wall section, and the output element has a planar wall section. The planar wall section of the lever element interacts with the planar wall section of the output element in such a way that the at least one lever element is coupled to the output element fixedly so as to rotate with it with regard to the force action axis.

The planar wall section of the lever element and the planar wall section of the output element are, in particular, planar in a plane which is approximately plane-parallel to the force action axis.

This has the advantage that the planar wall sections of the lever element and the output element can be realized particularly simply in terms of manufacturing technology. The lever element and the output element can therefore be manufactured in a very simple and reliable way. Furthermore, a rotational movement of the lever element with respect to the output element can be prevented reliably.

In a further embodiment, the coupling section of the lever element has a planar wall section, and the housing recess has a planar wall section. The planar wall section of the lever element interacts with the planar wall section of the housing recess in such a way that the at least one lever element is coupled to the housing fixedly so as to rotate with it with regard to the force action axis.

The planar wall section of the lever element and the planar wall section of the housing recess are, in particular, planar in a plane which is approximately plane-parallel with respect to the force action axis.

This has the advantage that the lever element and the housing can be manufactured in a very simple way. Furthermore, a rotational movement of the lever element with respect to the housing can be prevented reliably.

In a further embodiment, the coupling section of the lever element has a recess, and the housing has a pin. The pin is arranged in the recess of the coupling section of the lever element in such a way that the at least one lever element is coupled to the housing fixedly so as to rotate with it with regard to the force action axis. This has the advantage that a rotational movement of the lever element with respect to the housing can thus be prevented particularly reliably.

Other embodiments provide an injection valve which comprises the lever device and a valve needle. The valve needle is coupled to the output element or forms the output element. The drive element and the valve needle are coupled to one another via the lever device in such a way that, depending on an actuating signal, the valve needle prevents a fluid flow through the injection valve in a closed position and otherwise releases said fluid flow. A valve of this type can be operated with long-term reliability on account of the coupling of the lever element with respect to the housing or the valve needle.

FIG. 1 shows a valve, in particular an injection valve 10 for an internal combustion engine in a motor vehicle.

The injection valve 10 has a housing 12. The housing 12 has a shim 12*a* which is arranged between two tubular sections 12*b* of the housing 12. The shim 12*a* and the two tubular sections 12*b* are coupled fixedly to one another and together form the housing 12. A housing recess 14 with a fluid inlet 16 and a fluid outlet 18 is formed in the housing 12. Fuel can be fed to the injection valve 10 in the region of the fluid inlet 16 via a connector (not shown) which is coupled hydraulically to the housing recess 14.

A valve needle 20 is arranged axially movably in the housing recess 14, which valve needle 20 closes an injection nozzle 22 in a closed position and otherwise makes a fuel flow through the injection nozzle 22 possible.

The injection valve 10 comprises a piezo-electric actuator 24. Instead of the piezo-electric actuator 24, another actuator can also be provided, for example a magnetostrictive actuator or an electromagnetic actuator.

Furthermore, the injection valve 10 comprises a drive element 26 which is coupled to the actuator 24. The drive element 26 preferably has a pin or rod which transmits the stroke and a drive force of the actuator 24. The actuator 24 and the drive element 26 are coupled to one another in the axial direction. The stroke of the drive element 26 is dependent on an axial extent of the piezo-electric actuator 24, which axial extent is dependent on an actuating signal which can be fed to the piezo-electric actuator 24. Furthermore, the drive element 26 comprises a preferably bell-shaped structural element 27.

Furthermore, a lever device 28 is arranged in the housing recess 14 of the injection valve 10. The lever device 28 comprises the drive element 26 and a lever element 30 or a plurality of lever elements 30. In the embodiments which are shown, the lever device 28 has two lever elements 30. The lever elements 30 are coupled to the drive element 26. Furthermore, the lever elements 30 are coupled to an output element 32. The output element 32 is arranged in the housing recess 14. The output element 32 is preferably coupled to the valve needle 20. The valve needle 20 can also form the output element 32. The drive element 26, the lever element 30 and the output element 32 interact in such a way that the stroke of the drive element 26 is transmitted to the valve needle 20, and that the valve needle 20 is therefore moved into its closed position or into an open position.

The force action axis A of a drive force of the drive element 26 runs through the drive element 26 and, furthermore, as a force action axis of an output force, through the output element 32. In further embodiments, the force action axis through the drive element 26 is offset with respect to the force action axis through the output element 32.

Figure 2:
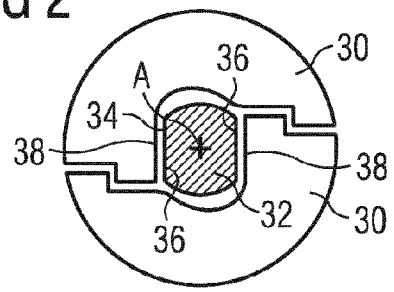
FIG. 2 shows a cross section through a lever device in a first embodiment.

FIG. 2 shows a first embodiment of the lever device 28 in a cross section.

The lever elements 30 have in each case one coupling section 34. In the embodiment which is shown in FIG. 2, the output element 32 has two planar wall sections 36. The planar wall sections 36 lie opposite one another with regard to the force action axis A of the output element 32. Furthermore, the coupling sections 34 of the lever elements 30 have in each case one planar wall section 38. The planar wall sections 38 of the lever elements 30 are assigned to the planar wall sections 36 of the output element 32. In each case one of the planar wall sections 38 of the lever element 30 lies opposite the planar wall section 36 of the output element 32. The planar wall sections 36 of the output element 32 therefore interact with the planar wall sections 38 of the lever element 30, and therefore make it possible that the lever elements 30 are coupled to the output element 32 fixedly so as to rotate with it with regard to the force action axis A. It can therefore be achieved that the lever elements 30 can no longer rotate with respect to the valve needle 20. The conditions during the injection of the injection valve 10 can therefore also be kept constant over a large number of injection operations.

Figure 3:
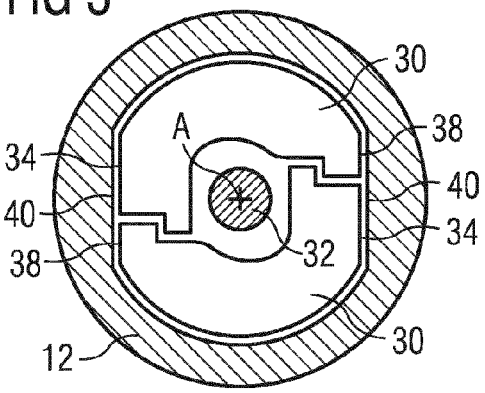
FIG. 3 shows a cross section through a lever device in a further embodiment.

In the embodiment of the lever device 28 which is shown in FIG. 3, the coupling sections 34 of the lever elements 30 have planar wall sections 38. The housing recess 14 of the housing 12 has two planar wall sections 40 which lie opposite one another with regard to the force action axis A. In each case one of the planar wall sections 38 of one of the lever elements 30 interacts with one of the planar wall sections 40 of the housing recess 14. As a result, it can be achieved that the lever element 30 is coupled to the housing 12 fixedly so as to rotate with it with regard to the force action axis A. As a result of the fixed coupling of the lever elements 30 to the housing 12 so as to rotate with it, it is possible that the contact conditions between the lever elements 30 and the housing 12 can be kept constant over a long time period. The injection behavior of the injection valve 10 can therefore also be kept constant over a long time period.

Figure 4:
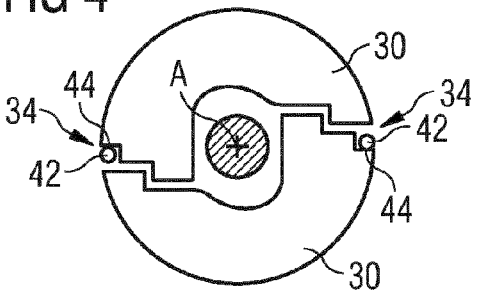
FIG. 4 shows a cross section through a lever device in a further embodiment.
Figure 5:
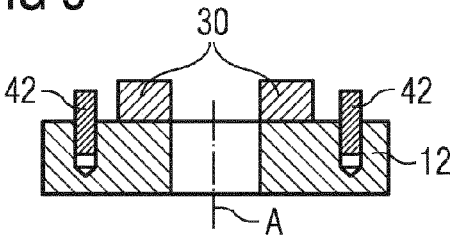
FIG. 5 shows a further cross section through the lever device of the embodiment from FIG. 4.

In the embodiment which is shown in FIGS. 4 and 5, holes are arranged in the shim 12*a* of the housing 12. The holes are configured, in particular, as blind holes. Pins 42 are arranged in the holes.

The coupling sections 34 of the lever elements 30 have in each case one recess 44. The pins 42 engage into the recesses 44 of the coupling sections 34 of the lever elements 30. It can therefore be achieved that the lever elements 30 are coupled to the shim 12*a* of the housing 12 fixedly so as to rotate with it with regard to the force action axis A.

As a result of the fixed coupling between the lever elements 30 and the housing 12 so as to rotate together, it can be achieved that the lever elements 30 can assume a fixed position with respect to the housing 12 even over a multiplicity of injection operations. As a result, stable injection conditions of the injection valve 10 can be achieved even over a multiplicity of injection operations of the injection valve 10. It can be achieved as a result that component tolerances have only a minor effect on the injection quantities of the injection valve 10.

What is claimed is:

1. A lever device for an injection valve, the lever device comprising:

a housing having a housing recess, at least one lever element arranged in the housing recess, a drive element arranged in the housing recess and coupled to the at least one lever element for acting on the at least one lever element in a direction of a force action axis, and an output element arranged in the housing recess and coupled to the at least one lever element such that the output element is moveable in the direction of the force action axis by the at least one lever element, and wherein a coupling section of each lever element comprises a planar wall section that interacts with a corresponding planar wall section of the output element such that each lever element is fixedly coupled to the output element and during actuation, each lever element rotates with the output element around the force action axis.

2. The lever device of claim 1, wherein the coupling section of each lever element comprises a planar wall section that interacts with a corresponding planar wall section of the housing recess such that each lever element is fixedly coupled to the housing and during actuation, each lever element rotates with the housing around the force action axis.

3. A lever device for an injection valve, the lever device comprising:

a housing having a housing recess, at least one lever element arranged in the housing recess, a drive element arranged in the housing recess and coupled to the at least one lever element for acting on the at least one lever element in a direction of a force action axis, and an output element arranged in the housing recess and coupled to the at least one lever element such that the output element is moveable in the direction of the force action axis by the at least one lever element, wherein each of the at least one lever element comprises a coupling section of each lever element comprising a recess, and the housing comprises a pin arranged in the recess of the coupling section of each lever element such that each lever element is fixedly coupled to the housing fixedly such that each lever element rotates with the housing around the force action axis.

4. The lever device of claim 3, wherein the pin extends parallel to the force action axis.

5. The lever device of claim 3, comprising a first lever element and a second lever element, wherein the coupling section of the first lever element comprises a first planar wall section, and the coupling section of the second lever element comprises a second planar wall section that is co-planar with the first planar wall section of the first lever element.

6. The lever device of claim 3, wherein the coupling section of each lever element comprises a pair of planar wall sections on opposite sides of the respective lever element.

7. An injection valve, comprising:

a lever device comprising:

a housing having a housing recess, at least one lever element arranged in the housing recess, a drive element arranged in the housing recess and coupled to the at least one lever element for acting on the at least one lever element in a direction of a force action axis, and an output element arranged in the housing recess and coupled to the at least one lever element such that the output element is moveable in the direction of the force action axis by the at least one lever element, each lever element of the lever device comprises a coupling section with a planar wall section that interacts with a corresponding planar wall section of the output element such that each lever element is fixedly coupled to the output element and during actuation, each lever element rotates with the output element around the force action axis, a valve needle coupled to or defining the output element, wherein the drive element of the lever device and the valve needle are coupled to each another such that, based on an actuating signal, the valve needle prevents a fluid flow through the injection valve in a closed position of the valve needle and releases a fluid flow through the injection valve in other positions of the valve needle.

8. The injection valve of claim 7, wherein the coupling section of each lever element of the lever device comprises a planar wall section that interacts with a corresponding planar wall section of the housing recess such that each lever element is fixedly coupled to the housing and during actuation, each lever element rotates with the housing around the force action axis.

9. An injection valve, comprising:

a lever device comprising:

a housing having a housing recess, at least one lever element arranged in the housing recess, a drive element arranged in the housing recess and coupled to the at least one lever element for acting on the at least one lever element in a direction of a force action axis, and an output element arranged in the housing recess and coupled to the at least one lever element such that the output element is moveable in the direction of the force action axis by the at least one lever element, wherein each of the at least one lever element comprises a coupling section comprising a recess, a valve needle coupled to or defining the output element, wherein the drive element of the lever device and the valve needle are coupled to each another such that, based on an actuating signal, the valve needle prevents a fluid flow through the injection valve in a closed position of the valve needle and releases a fluid flow through the injection valve in other positions of the valve needle, and the housing comprises a pin arranged in the recess of the coupling section of each lever element such that each lever element is fixedly coupled to the housing fixedly such that each lever element rotates with the housing around the force action axis.

10. The injection valve of claim 9, wherein each pin extends parallel to the force action axis.

11. The injection valve of claim 9, wherein the lever device comprises a first lever element and a second lever element, wherein the coupling section of the first lever element comprises a first planar wall section, and the coupling section of the second lever element comprises a second planar wall section that is co-planar with the first planar wall section of the first lever element.

12. The injection valve of claim 9, wherein the coupling section of each lever element of the lever device comprises a pair of planar wall sections on opposite sides of the respective lever element.

* * * * *